US007472762B2

(12) United States Patent
West et al.

(10) Patent No.: US 7,472,762 B2
(45) Date of Patent: Jan. 6, 2009

(54) TOP DRIVE OIL FLOW PATH SEALS

(75) Inventors: Neil Edward West, Corona, CA (US); Bastiaan de Jong, Rancho Santa Margarita, CA (US)

(73) Assignee: Varco I/P, Inc., Houston, TX (US)

( * ) Notice: Subject to any disclaimer, the term of this patent is extended or adjusted under 35 U.S.C. 154(b) by 141 days.

(21) Appl. No.: 11/634,680

(22) Filed: Dec. 6, 2006

(65) Prior Publication Data

US 2008/0136109 A1 Jun. 12, 2008

(51) Int. Cl.
*E21B 15/00* (2006.01)
*E21B 19/08* (2006.01)
*E21B 3/02* (2006.01)

(52) U.S. Cl. ..... 175/162; 175/113; 166/77.51; 277/377

(58) Field of Classification Search ..... 175/162, 175/213, 220, 113; 166/77.51; 277/377
See application file for complete search history.

(56) References Cited

U.S. PATENT DOCUMENTS

| | | | | | |
|---|---|---|---|---|---|
| 2,354,724 | A | | 8/1944 | Wessenger | 384/614 |
| 3,598,188 | A | | 8/1971 | Foster | 173/165 |
| 3,766,991 | A | | 10/1973 | Brown | 173/20 |
| 3,915,034 | A | | 10/1975 | Ward | 475/208 |
| 4,090,574 | A | * | 5/1978 | Garrison | 175/106 |
| 4,458,768 | A | | 7/1984 | Boyadjieff | 175/85 |
| 4,564,068 | A | * | 1/1986 | Baugh | 166/123 |
| 4,753,300 | A | | 6/1988 | Shaw et al. | 173/164 |
| 4,799,564 | A | | 1/1989 | Iimima et al. | 180/65.5 |
| 4,813,493 | A | | 3/1989 | Shaw et al. | 173/164 |
| 4,872,517 | A | * | 10/1989 | Shaw et al. | 173/218 |
| 4,878,546 | A | | 11/1989 | Shaw et al. | 173/213 |
| 4,984,641 | A | | 1/1991 | Pryor | 175/170 |
| 5,388,651 | A | * | 2/1995 | Berry | 175/85 |
| 5,433,279 | A | | 7/1995 | Tesari | 173/213 |
| 6,007,105 | A | | 12/1999 | Dietle et al. | 285/94 |
| 6,039,115 | A | * | 3/2000 | Mills | 166/68.5 |
| 6,276,450 | B1 | | 8/2001 | Seneviratne | 166/85.1 |
| 6,536,520 | B1 | | 3/2003 | Snider et al. | 166/78.1 |
| 6,679,333 | B2 | | 1/2004 | York et al. | 166/379 |
| 6,705,405 | B1 | | 3/2004 | Pietras | 166/380 |
| 6,725,949 | B2 | * | 4/2004 | Seneviratne | 175/85 |
| 6,824,495 | B1 | * | 11/2004 | Kirschner | 475/348 |
| 6,923,254 | B2 | | 8/2005 | Morrow et al. | 166/88.4 |
| 7,222,683 | B2 | | 5/2007 | Folk et al. | 175/162 |
| 7,231,969 | B2 | | 6/2007 | Folk et al. | 166/77.51 |
| 7,320,374 | B2 | * | 1/2008 | Folk et al. | 175/220 |

(Continued)

*Primary Examiner*—Shane Bomar
(74) *Attorney, Agent, or Firm*—Guy McClung

(57) ABSTRACT

A top drive system including, in certain aspects, a motor, a gear system below, and driven by the motor, a space between the top drive motor and the gear system, a seal assembly for inhibiting oil for lubricating parts of the gear system from flowing into the space, the seal assembly having a movable rod piston, a sealing arm projecting from the rod piston, at least one removable seal secured to the sealing arm, a seal member releasably secured to the gear system, and the movable rod piston movable to move the sealing arm to bring the at least one removable seal into sealingly contact with the seal member to inhibit oil from flowing into the space.

13 Claims, 7 Drawing Sheets

U.S. PATENT DOCUMENTS

2003/0205864 A1* 11/2003 Dietle et al. ..... 277/434
2004/0177971 A1* 9/2004 Seneviratne ..... 166/380
2005/0274508 A1* 12/2005 Folk et al. ..... 166/77.52
2007/0158112 A1* 7/2007 Schapel et al. ..... 175/195
2007/0251705 A1* 11/2007 Wells et al. ..... 166/387
2007/0267195 A1* 11/2007 Grigar et al. ..... 166/297

* cited by examiner

TOP DRIVE OIL FLOW PATH SEALS

BACKGROUND OF THE INVENTION

1. Field of the Invention

This invention is directed to seals between interfacing apparatuses; to lubricating oil flow path seals; and, in certain particular aspects, to seals for inhibiting lubricating oil flow from a top drive gear system to a top drive motor.

2. Description of Related Art

The prior art discloses a variety of top drive systems; for example, and not by way of limitation, the following U.S. Patents present exemplary top drive systems and components thereof: U.S. Pat. Nos. 4,458,768; 4,807,890; 4,984,641; 5,433,279; 6,276,450; 4,813,493; 6,705,405; 4,800,968; 4,878,546; 4,872,577; 4,753,300; 6,007,105; 6,536,520; 6,679,333; 6,923,254—all these patents incorporated fully herein for all purposes.

Certain typical prior art top drive drilling systems have a derrick supporting a top drive which rotates tubulars, e.g., drill pipe. The top drive is supported from a travelling block beneath a crown block. A drawworks on a rig floor raises and lowers the top drive. The top drive moves on a guide track.

In many typical prior art top drive systems the top drive includes a motor which meshes with and drives a gear system below the motor to drive a drive shaft for drilling and other operations. Lubricating oil lubricates and is maintained in the gear system. A seal, seal assembly, or seals selectively prevent the gear lubricating oil from flowing from the gear system to a space or cavity below the motor, to the motor shaft, and to the motor. In the past metal-to-metal seals have been used to close off this flow path; but, especially with higher and higher top drive gear speeds, metal-to-metal seals can wear relatively quickly. Also, many metal-to-metal seals require that a flat surface on a seal sealingly contact a flat surface of another member to effect a good seal.

BRIEF SUMMARY OF THE INVENTION

The present invention, in certain aspects, provides a top drive system with a motor and a gear system and a selectively movable seal assembly for selectively preventing gear lubricating oil in a bath around the gear system from flowing from the gear system into a cavity below the motor (from which it could flow to the motor shaft), e.g. when the top drive system is positioned non-vertically or is titled. In one aspect the movable seal assembly includes a rod piston and a sealing arm extending from the rod piston, the sealing arm having one, two, or more seals therein. In certain aspects, one or more seals of the seal assembly are non-metal.

In certain aspects such a seal assembly includes a seal movable by a spring to close off a gear lubricating oil flow path when the top drive stops. Without a seal, lubricating oil could flow into a cavity above the gear system. The seal is movable to contact part of a gear system to close off this flow path.

In one particular aspect, a gear seal member is releasably secured to a gear of a gear system and the movable seal assembly has a sealing arm extending therefrom to which is secured an O-ring seal (or two or more O-ring seals). The sealing arm is located for movement toward and away from the seal member on the gear. When the O-ring(s) of the member movable seal abuts the gear seal member, the flow of lubricating oil from the gear system to the cavity below the motor is inhibited or prevented. When either the O-ring(s) or the gear seal member on the gear wears or breaks, the worn or broken seal(s) and/or gear seal member can be removed and replaced. In one aspect, two O-ring seals are located on the movable sealing arm for sealingly contacting the gear seal member.

In one aspect, the movable seal assembly is moved in response to the pressure of lubricating oil introduced into the gear system.

The present invention discloses, in certain aspects, a top drive system for wellbore operations, the top drive system including: a top drive motor; a gear system below, meshing with, and driven by the motor; a space between the top drive motor and the gear system; a seal assembly for inhibiting oil for lubricating parts of the gear system from flowing into the space, the seal assembly including a movable rod piston, a sealing arm projecting from the rod piston, at least one removable seal secured to the sealing arm, at least a part of the at least one removable seal projecting beyond the sealing arm, a seal member releasably secured to the gear system, and the movable rod piston movable to move the sealing arm to bring the at least one removable seal into sealingly contact with the seal member to inhibit oil from flowing into the space.

The present invention discloses, in certain aspects, a seal assembly for a top drive system for wellbore operations, the top drive system having a top drive motor, a gear system below, meshing with, and driven by the motor, a seal member releasably secured to the gear system, and a space between the top drive motor and the gear system, the seal assembly for inhibiting oil for lubricating parts of the gear system from flowing into the space, the seal assembly including: a movable rod piston; a sealing arm projecting from the rod piston; at least one removable seal secured to the sealing arm, at least a part of the at least one removable seal projecting beyond the sealing arm; and the movable rod piston movable to move the sealing arm to bring the at least one removable seal into sealingly contact with the seal member to inhibit oil from flowing into the space.

Accordingly, the present invention includes features and advantages which are believed to enable it to advance top drive lubricating oil flow path sealing technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide:

New, useful, unique, efficient, non-obvious top drive systems, gear systems for them, gear lubricating oil flow path seal assemblies, and methods of their use;

Such systems with a movable seal for selectively closing off an oil flow path to prevent gear lubricating oil from flowing to a cavity adjacent a top drive motor shaft; and Such systems with a gear seal member releasably secured to part of a gear system for sealing contact by an oil flow path movable seal.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

Figure 1A:
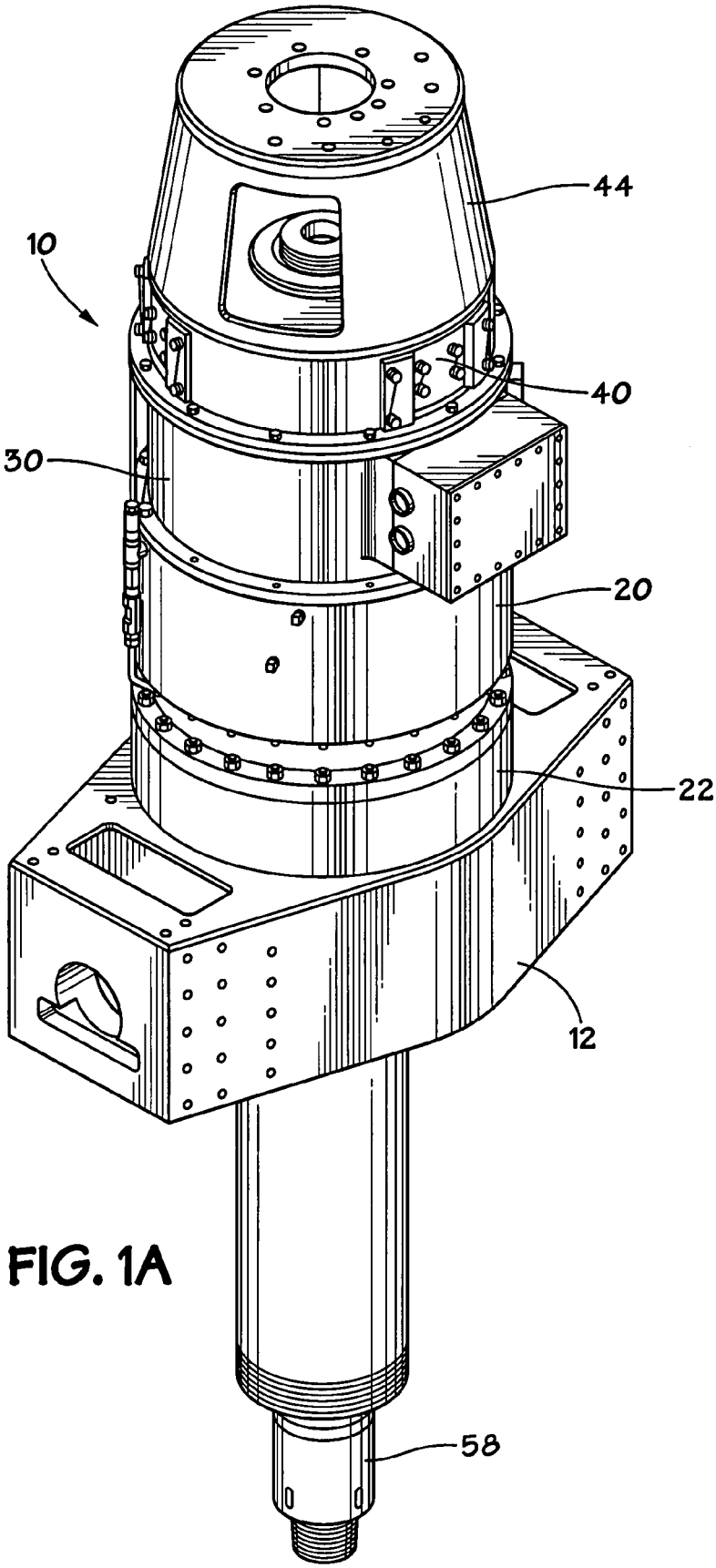
FIG. 1A is a perspective view of a top drive system according to the present invention.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference.

DETAILED DESCRIPTION OF THE INVENTION

Figure 1B:
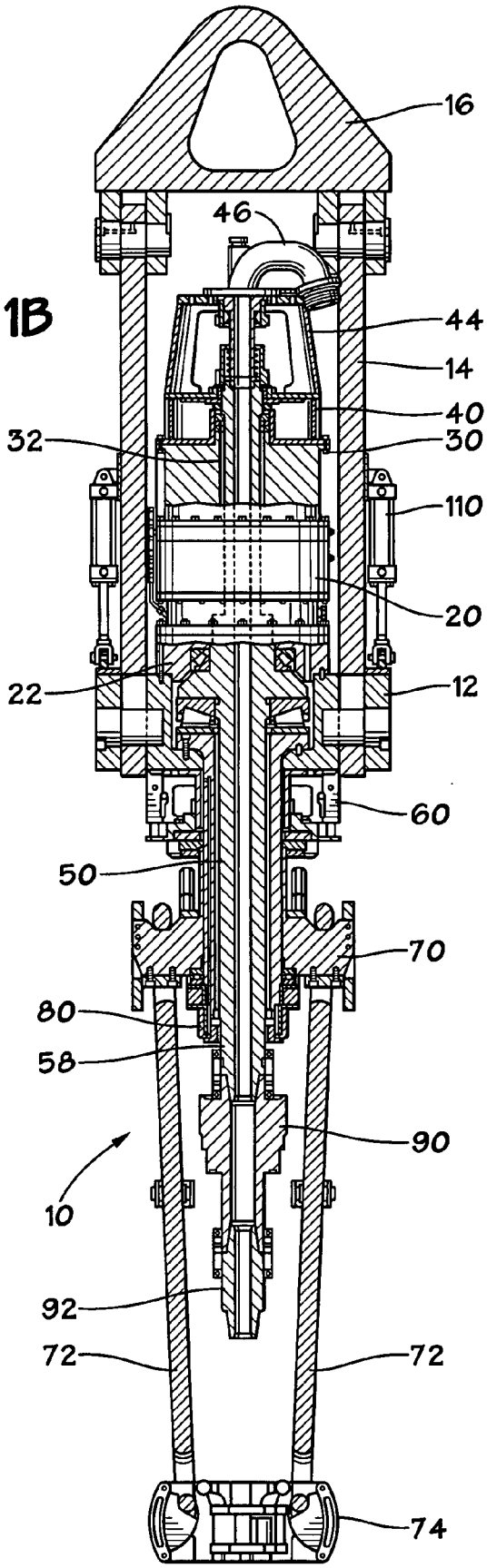
FIG. 1B is a side cross-section view of a top drive system according to the present invention like the system of FIG. 1A.

FIGS. 1A and 1B show a top drive system 10 according to the present invention which has a swivel body 12 suspended with links 14 from a becket 16. The becket 16 is connected to a travelling block (not shown). A gear system 20 (also "gearbox" or "gearbox system") according to the present invention is mounted on a spacer plate 22 which is supported by the swivel body 12.

A motor 30 is coupled to and drives the gear system 20. Any suitable motor may be used. A brake system 40 connected to the motor 30 is within a bonnet 44 through which extends a gooseneck 46 connected to a kelly hose (not shown) adjacent a service loop through which flows drilling fluid.

The motor 30 has a drive shaft 32 which drivingly meshes with and drives the gear system 20. A drive quill 50 is driven by the gear system 20. The gear system 20, the spacer plate 22, the swivel body 12, a locking system 60, a load collar 70, and a rotary seal 80 are included in the system 10. A lower end 58 of the quill 50 is threadedly connected to a mud saver system 90 which itself is connected to a saver sub 92. Oil for lubricating the gear system 20 is pumped from the swivel body 12 to the gear system 20.

A counterbalance system 110 (which can hold the weight of the entire system 10 during stabbing of tubulars) includes two load compensators and permits a soft landing for a tubular when the top drive is lowered to stab a tubular into a connection. The locking mechanism 60 is bolted beneath the swivel body 12 and provides releasable locking of the system in a desired position.

Figure 2A:
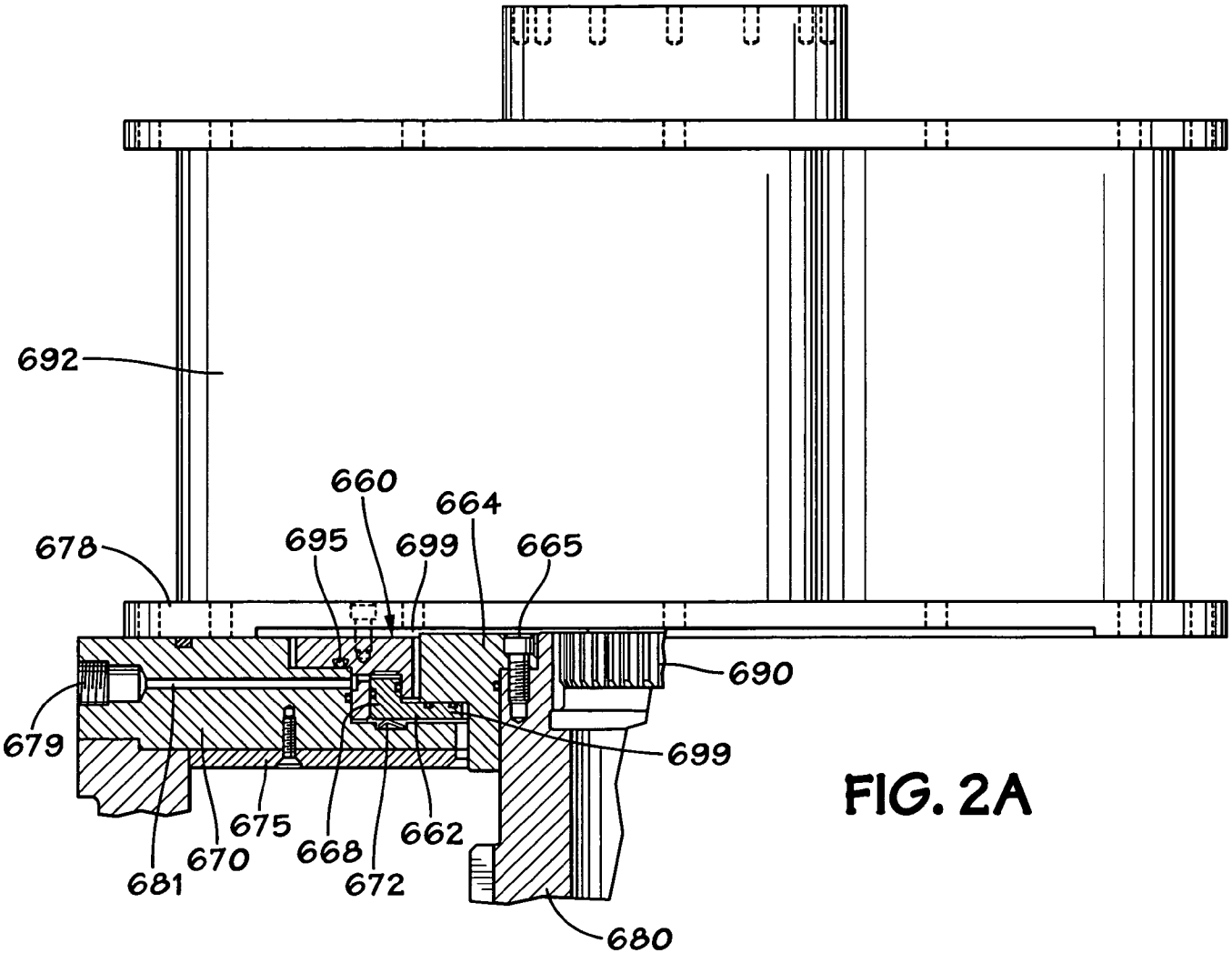
FIG. 2A is a side view of a system according to the present invention, partly in cross-section.
Figure 2B:
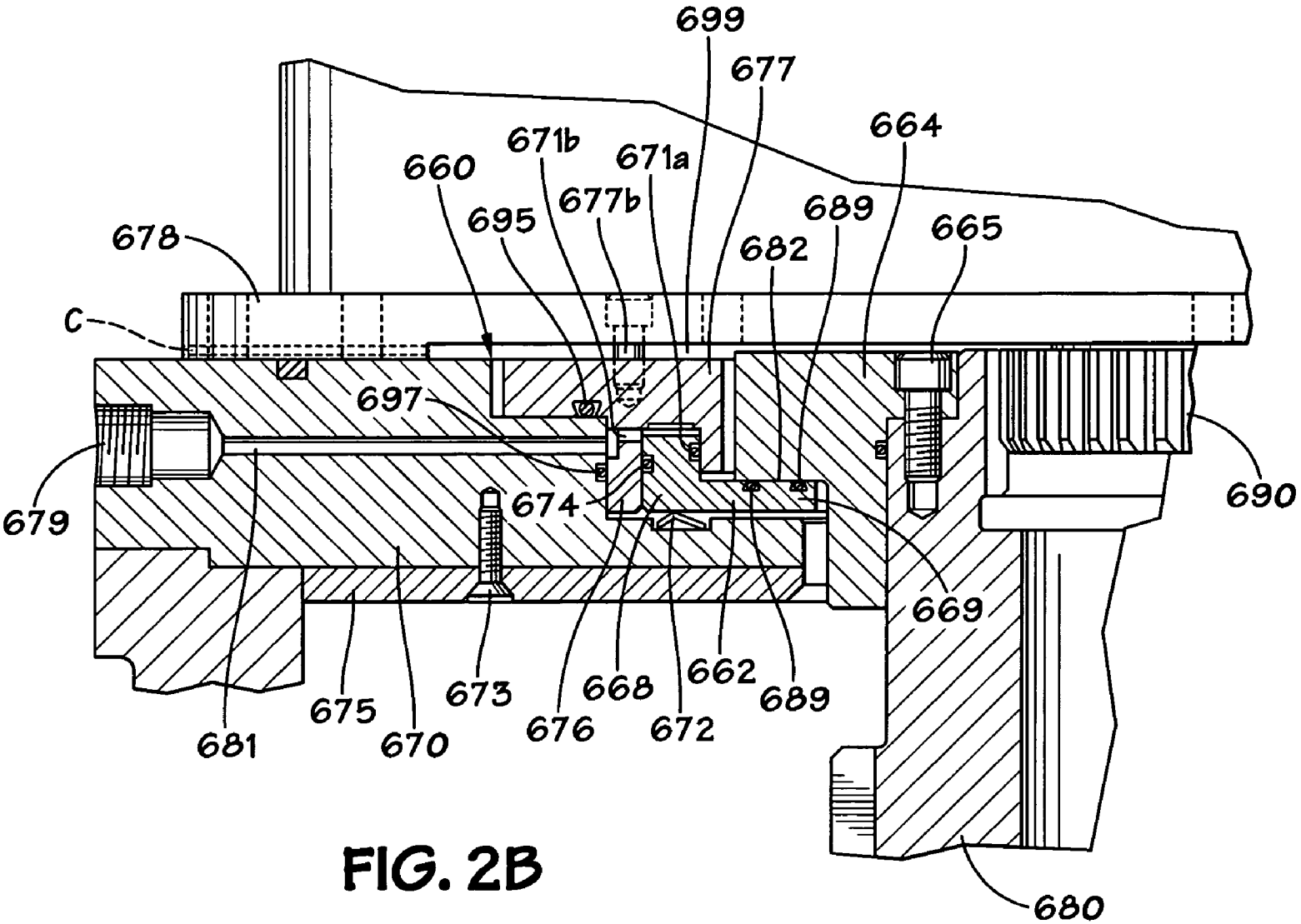
FIG. 2B is an enlarged view of part of the system of FIG. 2A.

FIGS. 2A and 2B illustrate an embodiment of a seal system 660 according to the present invention for sealing between a gear system and a cavity below a motor of a top drive system (half system shown in each figure) e.g., a cavity below the motor 30 and above the gear system 20, FIG. 1A.

The seal system 660 has a lift seal 662 which seals against a surface 682 of a seal member 664 connected to a rotating sun gear 680 of a gear system 690. The lift seal 662 has a rod piston 668 which is movable up and down with respect to a non-rotating seal housing 670 (top plate of gear box). A bolt 665 secures the seal member 664 to the sun gear 680. The rod piston 668 has a seal arm 669 projecting therefrom which is located beneath a lower sealing surface 682 of the seal member 664. Two O-ring seals 689 are disposed in corresponding recesses 689*a* in the seal arm 669. These O-ring seals 689 sealing abut the lower sealing surface 682 of the seal member

664 and seal off a flow path from below the lift seal 662 up to a cavity 699 below a motor 692. This cavity 699 is vented to atmosphere and oil therein can flow freely out of the cavity (e.g. shown schematically by a channel C in dotted lines in FIG. 2B).

A spring 672 initially urges the rod piston 668 upwardly, thus urging the seals 689 against the surface 682. The rod piston 668 moves in a member 677 which has a lower side 676. Seals 674 and 671*a* seal the interface between the rod portion 668 and the housing 677. Seals 697 and 695 seal the member 677/seal-housing-670 interface. A bolt 677*b* secures the member 677 to the seal housing 670. A bottom flange 678 of the motor is on top of the seal housing 670 and the cavity 699 is below this flange. A bolt or bolts 673 secure an oil distribution plate 675 which channels oil to the gears to the seal housing 670.

The pathway that is sealed by the lift seal 662 is a pathway through which oil from the gear system can flow from the gear system to the cavity 699 below the motor 692 of a top drive system. When the top drive system is operational, oil flowing into an oil supply port 679 from an oil supply (not shown) and through a channel 681 into a chamber 677*a* pushes down on the rod piston 668 overcoming the spring 672 and the lift seal 662 is disengaged from the surface 682 of the seal member 664. When the top drive system is off and/or oil is not flowing through the channel 681, the spring 672 is not compressed by the oil and, therefore, the spring 672 urges the rod piston 668 and the seals 689 upwardly so that the seals 689 engage the surface 682, thus closing off the oil flow path and inhibiting or preventing oil from moving from or leaking from the gear system into the cavity 699 (and thus inhibits or prevents leakage from the cavity 699) (e.g., in one aspect, if the top drive system is in a non-vertical orientation). In certain aspects, if the O-ring(s) 689 wear down the top surface of the sealing arm 669 can seal against the surface 682 but this is not preferred although it may provide an effective seal. The O-ring(s) 689 may be made of any suitable O-ring material, e.g. BUNA material or PTFE.

Figure 2C:
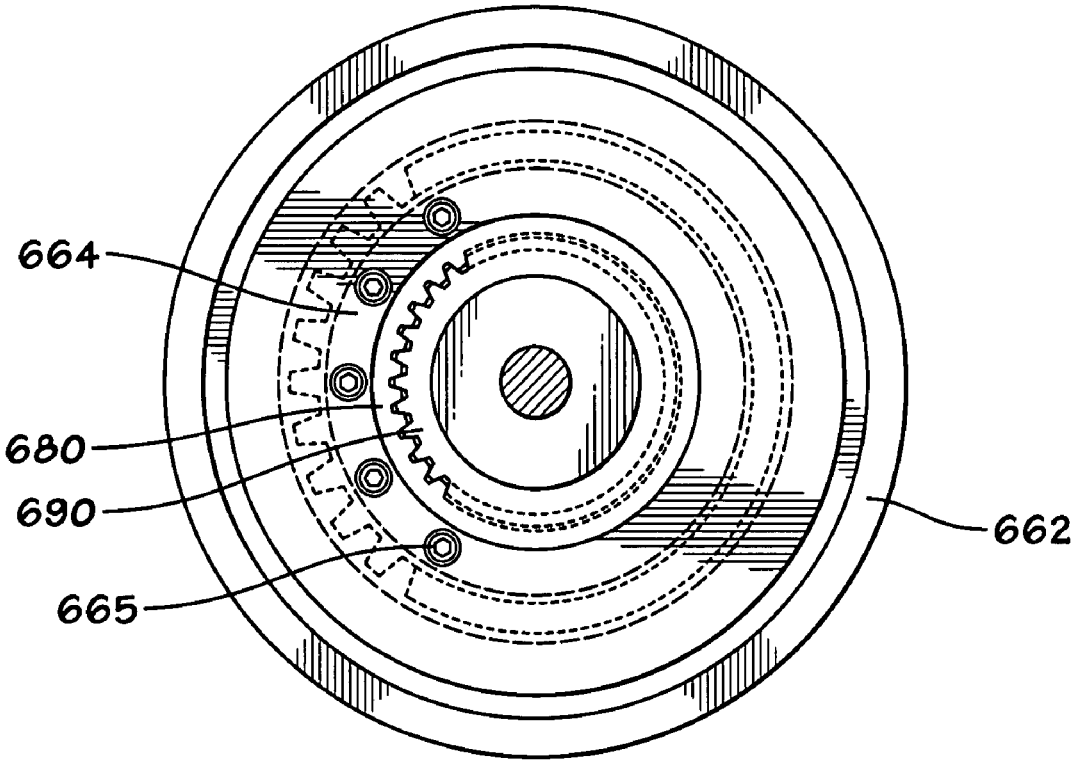
FIG. 2C is a top view of part of a seal assembly according to the present invention.
Figure 2D:
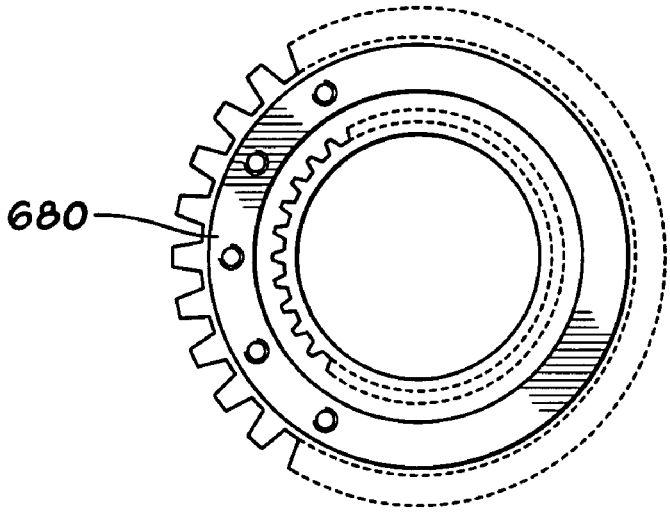
FIG. 2D is a top view of part of a seal assembly of FIG. 2C.
Figure 2E:
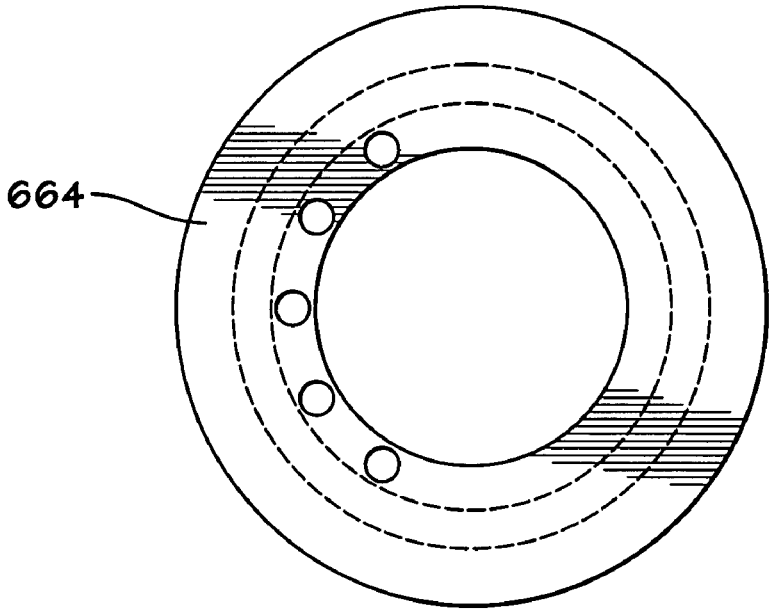
FIG. 2E is a top view of part of a seal assembly of FIG. 2C.
Figure 2F:
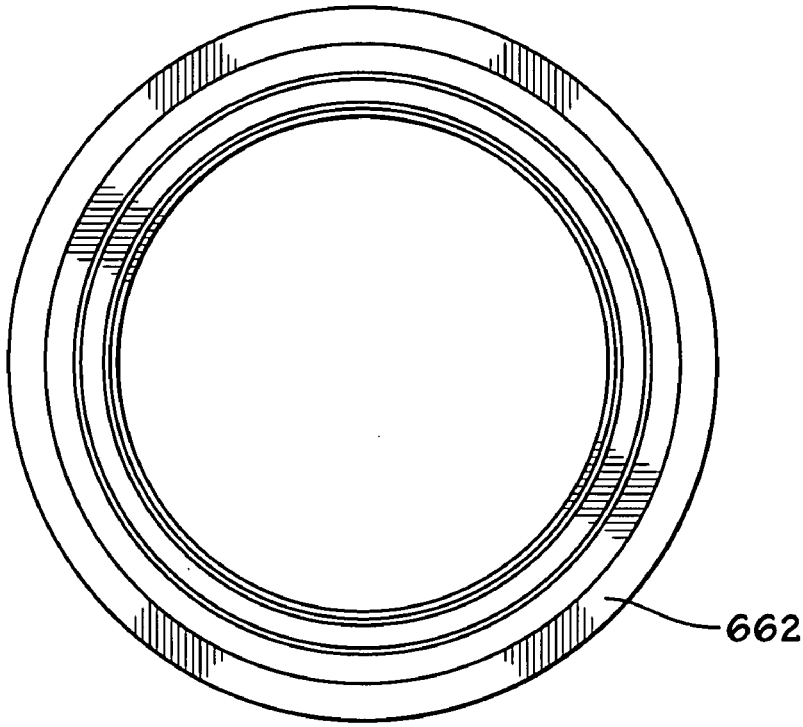
FIG. 2F is a top view of part of a seal assembly of FIG. 2C.

FIG. 2C shows one embodiment of a system according to the present invention with a lift seal 662, a sun gear 680, and a gear seal member 664 on the sun gear 680. FIGS. 2D-2F illustrate the relative sizes of these parts.

Figure 3:
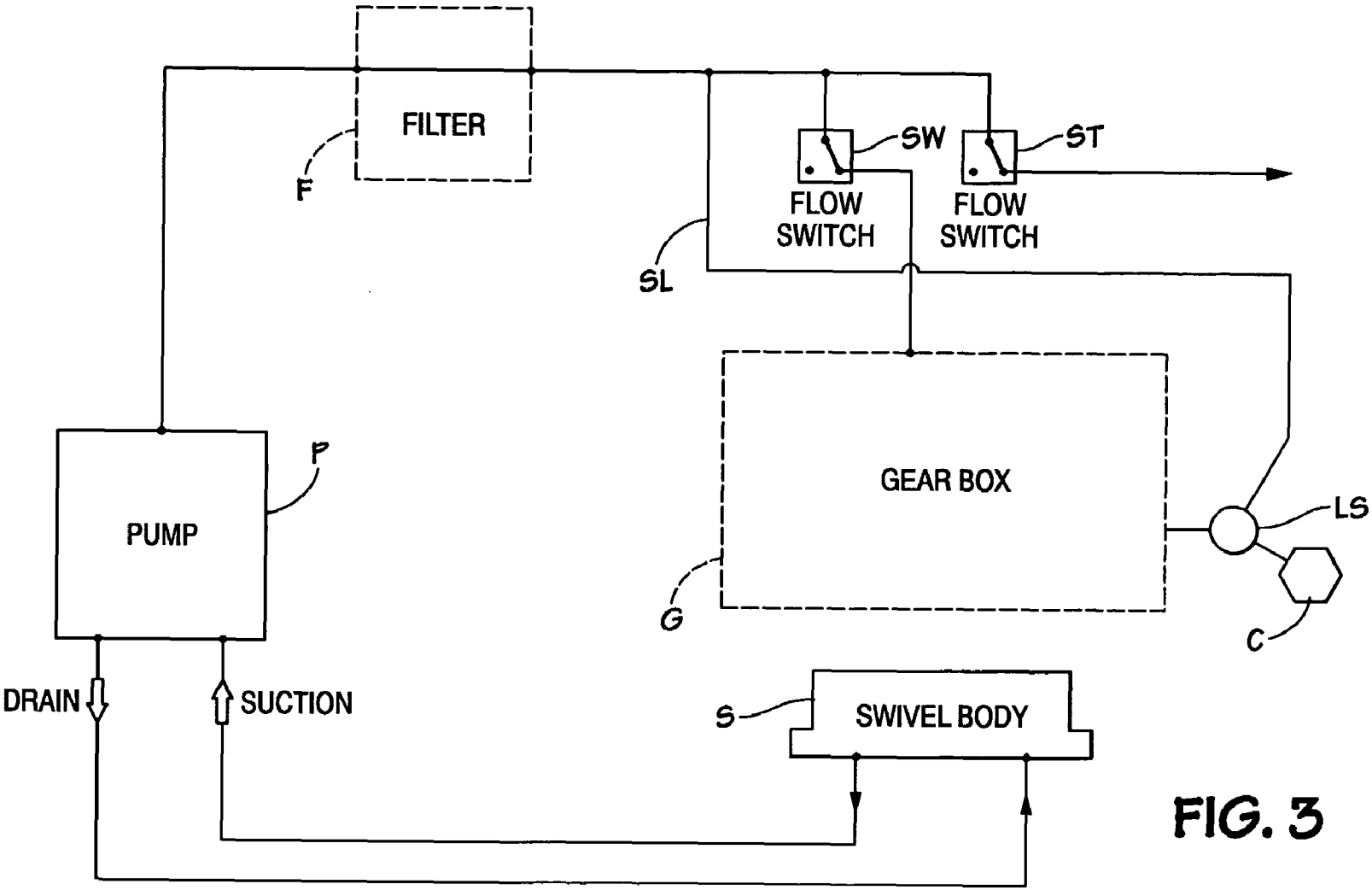
FIG. 3 is a schematic view of a system with a seal according to the present invention.

FIG. 3 shows a lubricating oil flow pattern for use with a lift seal according to the present invention (e.g. the lift seal 662, used with a gear system 20 and a swivel body 12 as in FIG. 2A). A pump P pumps gear lubricating oil from a swivel body S, through a filter F in a line S to a lift seal LS according to the present invention. With a switch SW open, lubricating oil flows to the gear system G. With the lift seal LS not closing off a flow path from the gear system G to a cavity C below a motor (not shown), lubricating oil can flow to the cavity C. With the lift seal LS closing off this path, oil cannot flow into the cavity C.

Optionally, with a switch ST open, oil can flow to the motor (e.g. to its shaft and/or upper or lower bearings).

The present invention, therefore, provides in at least certain embodiments, a top drive system for wellbore operations, the top drive system including: a top drive motor; a gear system below, meshing with, and driven by the motor; a space between the top drive motor and the gear system; a seal assembly for inhibiting oil for lubricating parts of the gear system from flowing into the space; the seal assembly including: a movable rod piston, a sealing arm projecting from the rod piston, at least one removable seal secured to the sealing arm, at least a part of the at least one removable seal projecting beyond the sealing arm, a seal member releasably secured to the gear system, and the movable rod piston movable to move the sealing arm to bring the at least one removable seal into sealingly contact with the seal member to inhibit oil from flowing into the space. Such a system may have one or some (in any possible combination) of the following: wherein the at least one removable seal is an O-ring; wherein the at least one removable seal is two spaced-apart removable seals; wherein the two spaced-apart removable seals are O-rings; a vent system for oil to flow from the space out from the top drive system; a housing for the gear system, a chamber within the housing, the rod piston located in and movable within the chamber, and a spring urging the rod piston upward and urging the sealing arm and the at least one removable seal into sealing contact with the seal member; a fluid flow channel in fluid communication with the chamber, a portion of the oil for lubricating parts of the gear system flowable into the fluid flow channel to overcome the spring and move the rod piston so that the at least one removable seal is moved out of sealing contact with the seal member; wherein the portion of the oil deadheads within the chamber; wherein the chamber is within a piston rod mounting structure, the piston rod mounting structure securable to the housing; wherein the seal member has a lower sealing surface, part of the sealing arm is below the lower sealing surface, the sealing arm is movable upwardly so that the at least one removable seal comes up to sealingly contact the lower sealing surface; and/or wherein the sealing arm has an arm flat surface which, upon sufficient wear of the at least one removable seal, is movable to sealingly abut the seal member, the seal member having a seal member flat surface for sealing abutment by the arm flat surface.

The present invention, therefore, provides in at least certain embodiments, a top drive system including: a top drive motor; a gear system below, meshing with, and driven by the motor; a space between the top drive motor and the gear system; a seal assembly for inhibiting oil for lubricating parts of the gear system from flowing into the space; the seal assembly including: a movable rod piston, a sealing arm projecting from the rod piston, two spaced-apart removable O-ring seals, secured to the sealing arm, at least a part of each O-ring seal projecting beyond the sealing arm, a seal member releasably secured to the gear system, the movable rod piston movable to move the sealing arm to bring the part of each spaced-apart removable O-ring seal projecting beyond the sealing arm into sealingly contact with the seal member to inhibit oil from flowing into the space, a vent system for oil to flow from the space out from the top drive system, a housing for the gear system, a chamber within the housing, the rod piston located in and movable within the chamber, a spring urging the rod piston upward and urging the sealing arm and the two spaced-part removable O-ring seals into sealing contact with the seal member, a fluid flow channel in fluid communication with the chamber, a portion of the oil for lubricating parts of the gear system flowable into the fluid flow channel to overcome the spring and move the rod piston so that the two spaced-apart removable O-ring seals are moved out of sealing contact with the seal member, wherein the portion of the oil deadheads within the chamber, the seal member has a lower sealing surface, part of the sealing arm is below the lower sealing surface, and the sealing arm is movable upwardly so that the two spaced-apart removable O-ring seals come up to sealingly contact the lower sealing surface.

The present invention, therefore, provides in at least certain embodiments, a seal assembly for a top drive system for wellbore operations, the top drive system having a top drive motor, a gear system below, meshing with, and driven by the motor, a seal member releasably secured to the gear system, and a space between the top drive motor and the gear system, the seal assembly for inhibiting oil for lubricating parts of the gear system from flowing into the space, the seal assembly including: a movable rod piston; a sealing arm projecting from the rod piston; at least one removable seal secured to the sealing arm, at least a part of the at least one removable seal projecting beyond the sealing arm; and the movable rod piston movable to move the sealing arm to bring the at least one removable seal into sealingly contact with the seal member to inhibit oil from flowing into the space. Such a system may have one or some (in any possible combination) of the following: wherein the at least one removable seal is an O-ring; wherein the at least one removable seal is two spaced-apart removable seals; wherein the two spaced-apart removable seals are O-rings; wherein the gear system is in a housing and there is a chamber within the housing, the seal assembly further including the rod piston located in and movable within the chamber, and a spring urging the rod piston upward and for urging the sealing arm and the at least one removable seal into sealing contact with the seal member; wherein there is a fluid flow channel in fluid communication with the chamber, and a portion of the oil for lubricating parts of the gear system is flowable into the fluid flow channel to overcome the spring and move the rod piston so that the at least one removable seal is movable out of sealing contact with the seal member; and/or wherein the seal member has a seal member flat surface, the seal assembly further including the sealing arm having an arm flat surface which, upon sufficient wear of the at least one removable seal, is movable to sealingly abut the flat surface of the seal member.

The present invention, therefore, provides in at least certain embodiments, a seal assembly for a top drive system for wellbore operations, the top drive system having a top drive motor, a gear system below, meshing with, and driven by the motor, a seal member releasably secured to the gear system, a housing for the gear system, a chamber within the housing, the seal member having a seal member flat surface for sealing abutment by the arm flat surface, a space between the top drive motor and the gear system, the seal assembly including: a seal assembly for inhibiting oil for lubricating parts of the gear system from flowing into the space; a movable rod piston; a sealing arm projecting from the rod piston; two spaced-apart removable seals are O-rings secured to the sealing arm, at least a part of each of the two spaced-apart removable O-ring seals projecting beyond the sealing arm; the movable rod piston movable to move the sealing arm to bring the at least one removable seal into sealingly contact with the seal member to inhibit oil from flowing into the space; the rod piston located in and movable within the chamber; a spring urging the rod piston upward and urging the sealing arm and the at least one removable seal into sealing contact with the seal member; and the sealing arm having an arm flat surface which, upon sufficient wear of the at least one removable seal, is movable to sealingly abut the seal member flat surface.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. All patents and applications referred to herein by number are incorporated fully herein for all purposes.

What is claimed is:

1. A top drive system for wellbore operations, the top drive system comprising a top drive motor, a gear system below, meshing with, and driven by the motor, a space between the top drive motor and the gear system, a seal assembly for inhibiting oil for lubricating parts of the gear system from flowing into the space, the seal assembly comprising a movable rod piston, a sealing arm projecting from the rod piston, a seal member, the seal member separate from the gear system, the seal member releasably secured to the gear system and selectively removable therefrom, and the movable rod piston movable to move the sealing arm into sealing contact with the seal member to inhibit oil from flowing into the space.

2. The top drive system of claim 1 further comprising at least one removable seal secured to the sealing arm, at least a part of the at least one removable seal projecting beyond the sealing arm, and the movable rod piston movable to bring the at least one removable seal into sealing contact with the seal member on the gear system.

3. The top drive system of claim 2 wherein the sealing arm has at least one recess therein, the at least one removable seal is en O-ring, the O-ring is in the at least one recess.

4. The top drive system of claim 2 wherein the at least one removable seal is two spaced-apart removable seals.

5. The top drive system of claim 4 wherein the sealing arm has two recesses and the two spaced-apart removable seals are O-rings, one O-ring in each recess.

6. The top drive system of claim 1 further comprising a vent system for oil to flow from the space out from the top drive system.

7. The top drive system of claim 1 further comprising a housing for the gear system, a chamber within the housing, the rod piston located in and movable within the chamber, and a spring urging the rod piston upward and urging the sealing arm into sealing contact with the seal member.

8. The top drive system of claim 7 further comprising a fluid flow channel in fluid communication with the chamber, a portion of the oil for lubricating parts of the gear system flowable into the fluid flow channel to overcome the spring and move the rod piston so that the at least one removable seal is moved out of sealing contact with the seal member.

9. The top drive system of claim 8 wherein the portion of the oil deadheads within the chamber.

10. The top drive system of claim 7 wherein the chamber is within a piston rod mounting structure, the piston rod mounting structure securable to the housing.

11. The top drive system of claim 2 wherein the sealing arm has an arm flat surface which, upon sufficient wear of the at least one removable seal, is movable to sealingly abut the seal member, the seal member having a seal member flat surface for sealing abutment by the arm flat surface.

12. A top drive system comprising a top drive motor, a gear system below, meshing with, and driven by the motor, a space between the top drive motor and the gear system, a seal assembly for inhibiting oil for lubricating parts of the gear system from flowing into the space, the seal assembly comprising a movable rod piston, a sealing arm projecting from the rod piston, two spaced-apart removable O-ring seals, secured to the sealing arm, at least a part of each O-ring seal projecting beyond the sealing arm, a seal member, the seal member separate from the gear system, the seal member releasably secured to the gear system and selectively removable therefrom, the movable rod piston movable to move the sealing arm to bring the part of each spaced-apart removable O-ring seal projecting beyond the sealing arm into sealingly contact with the seal member to inhibit oil from flowing into the space, a vent system for oil to flow from the space out from the top drive system, a housing for the gear system, a chamber within the housing, the rod piston located in and movable within the chamber, a spring urging the rod piston upward and urging the sealing arm and the two spaced-part removable O-ring seals into sealing contact with the seal member, a fluid flow channel in fluid communication with the chamber, a portion of the oil for lubricating parts of the gear system flowable into the fluid flow channel to overcome the spring and move the rod piston so that the two spaced-span removable O-ring seals are moved out of sealing contact with the seal member, the seal member has a lower sealing surface, part of the sealing arm is below the lower sealing surface, and the sealing arm is movable upwardly to sealingly contact the lower sealing surface.

13. A seal assembly for a top drive system for wellbore operations, the top drive system having a top drive motor, a gear system below, meshing with, and driven by the motor, a seal member separate from and releasably secured to the gear system and selectively removable therefrom, the seal member having a seal member flat surface for sealing abutment by an arm flat surface, a housing for the gear system, a chamber within the housing, an inner space between the top drive motor and the gear system, the seal assembly comprising a seal assembly for inhibiting oil for lubricating parts of the gear system from flowing into the inner space, a movable rod piston, a sealing arm projecting from the rod piston, two spaced-apart removable seals comprising O-rings secured to the sealing arm, at least a part of each of the two spaced-apart removable O-rings projecting beyond the sealing arm, the movable rod piston movable to move the sealing arm to bring the O-rings into sealingly contact with the seal member to inhibit oil from flowing into the inner space, a spring urging the rod piston upward and urging the O-rings into sealing contact with the seal member, and the sealing arm having an arm flat surface which is movable to sealingly abut the seal member flat surface.

* * * * *